United States Patent [19]

Tenbrink, Sr.

[11] 4,184,590

[45] Jan. 22, 1980

[54] COIN HOLDER AND COUNTER

[76] Inventor: Arthur Tenbrink, Sr., P.O. Box 66, Wilton, Conn. 06897

[21] Appl. No.: 769,524

[22] Filed: Feb. 17, 1977

[51] Int. Cl.[2] ..... A45C 11/28

[52] U.S. Cl. ..... 206/0.82; 220/66; 232/1 D; 414/675

[58] Field of Search ..... 206/0.8, 0.81, 0.82, 206/37; 220/66, 69; 214/1 C; 232/1 D

[56] References Cited

U.S. PATENT DOCUMENTS

| | | | |
|---|---|---|---|
| 2,683,526 | 7/1954 | Wheatley | 206/0.82 |
| 3,083,818 | 4/1963 | Lynghave et al. | 206/0.82 |
| 3,255,894 | 6/1966 | Handel et al. | 214/1 C |
| 3,346,109 | 10/1967 | Duran | 206/0.82 |
| 3,420,359 | 1/1969 | Cochrane | 206/0.82 |
| 3,476,240 | 11/1969 | Howell | 206/0.82 |

FOREIGN PATENT DOCUMENTS

| | | | |
|---|---|---|---|
| 595497 | 4/1960 | Canada | 206/0.82 |

*Primary Examiner*—Joseph Man-Fu Moy
*Attorney, Agent, or Firm*—Robert D. Farkas

[57] ABSTRACT

A coin holder that includes a flexible plastic shell open at both ends and having a longitudinal slit therein such that deforming the two ends allows the coin to be removed through the slit and a plurality of graduated markings along the slot to be used in conjunction with a spacing member for counting the coins as well as removing only a certain quantity from the shell.

4 Claims, 4 Drawing Figures

COIN HOLDER AND COUNTER

BACKGROUND OF THE INVENTION

This invention relates to a coin holder; more particularly to a flexible, deformable plastic coin holder wherein some or all of the coins may be removed therefrom without the need of having to break the holder.

The prior art teaches a variety of coin holders, for example as disclosed in U.S. Pat. Nos. 181,545; 608,521; 609,947; 675,853; 712,087; 3,095,084; 3,282,494; 3,286,717; 3,533,501 and others.

SUMMARY OF THE INVENTION

It is accordingly an object of the instant invention to provide for a new and improved coin holder.

It is another object to provide for one having the attributes as aforedescribed.

It is a further object to provide for the same at relatively little cost thereby making it generally available.

These and other objects and advantages of the invention will become more apparent from a consideration of the following detailed disclosure and claims and by reference to the accompanying drawing, in which:

Figure 1:
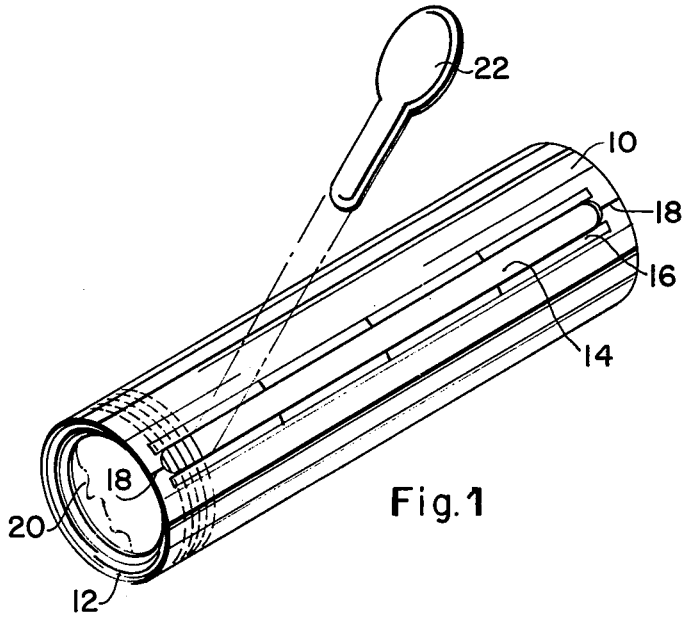
FIG. 1 is a perspective view.
Figure 2:
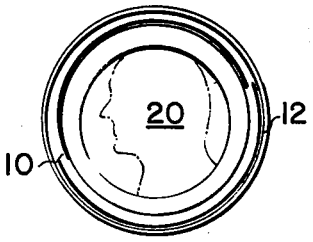
FIG. 2 is an end elevational view.
Figure 3:
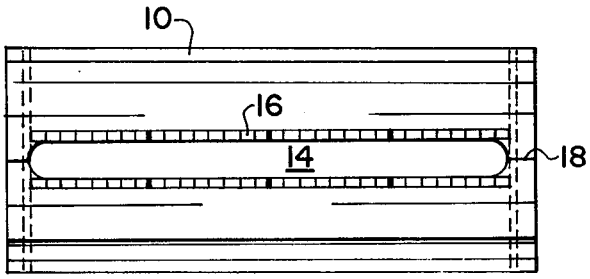
FIG. 3 is a top plan.
Figure 4:
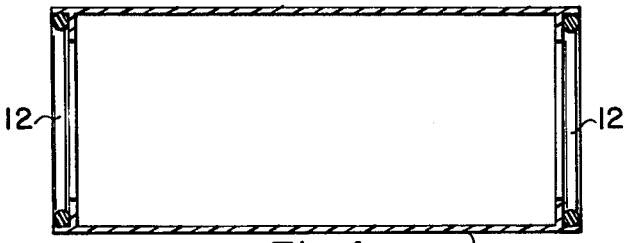
FIG. 4 is a longitudinal sectional view.

Broadly speaking, the instant invention includes the provision of a coin holder, comprising a walled tubular body of flexible, deformable sheet material, the wall defining an elongated longitudinally aligned aperture, rigid closure means disposed at opposite distal ends of the body, a pair of slits each communicating between the aperture and one of the distal ends whereby pressure exerted against the distal ends deforms the walled body and enlarges the aperture.

DETAILED DESCRIPTION OF THE PREFERRED EMBODIMENT

Referring more particularly to the drawings, there is shown an elongated tubular shaped walled shell or container 10 having a substantially circular section though it need not be and may be transparent if desired. Each end thereof is open and is bounded or circumscribed by an enlarged annular ring of substantially greater thickness than that of the wall of the shell 10. The wall of the shell 10 is constructed of a flexible, deformable material (i.e. plastic) while the ring 12 ends are constructed of a rigid material. An enlarged aperture 14 is defined longitudinally along the wall of the container 10, a plurality of marking indicia 16 are disposed along at least a part of the periphery thereof. A longitudinal slit 18 communicates between the aperture 14 and the distal end of the container 10 by splitting the annualr ring 12. In this fashion, when the two distal ends of the container 10 are deformed towards each other by pressing against the same with the thumb and forefinger, the aperture 14 is deformed and enlarged whereupon the coins 20 may be removed therefrom, one, several or all. As is apparent, the rings 12 have a small internal diameter than that of the internal diameter of the container 10 thereby preventing the coins 20 from being removed through the distal open ends. This is accomplished by having the wall portion of the ring 12 of an enlarged dimension. Alternatively, the ends of the container 10 need not be open but may be sealed by an end section of enlarged thickness relative to the wall thickness of the container 10 thereby accomplishing the same purpose.

A counter or spacer member 22 may be provided to facilitate counting the coins 20 through the aperture 14 or for separating them into two groups, one group to be left in the container 10 while the remaining group is allowed to fall from the container 10 through the aperture 14 which has been enlarged due to the deformation of the wall of the container by the pressure applied against the opposite ends. The spacer 22 is paddle shaped and has an external diameter smaller than the relaxed or normal internal diameter of the aperture 14.

Since it is obvious that numerous changes and modifications can be made in the above-described details without departing from the spirit and nature of the invention, it is to be understood that all such changes and modifications are included within the scope of the invention.

I claim:

1. A coin holder, comprising a walled tubular body of flexible, deformable sheet material, said wall defining an elongated longitudinally aligned aperture, rigid closure means disposed at opposite distal ends of said body, said distal ends of said body being open, said rigid closure means including a split annular ring, said ring having a predetermined internal diameter opening smaller then the internal diameter of said body, a pair of slits each communicating between one end of said aperture and one of said distal ends whereby pressure exerted against said distal ends deforms said walled body and enlarges said aperture.

2. The holder as defined in claim 1 wherein said wall includes indicia along at least a portion of the periphery thereof.

3. The holder as defined in claim 1 further including a paddle member, at least a portion of said member having a predetermined diameter smaller than the transverse opening of said aperture whereby said portion may be placed therein.

4. The holder as defined in claim 1 wherein said ring is a rigid material.

* * * * *